US009031427B2

(12) United States Patent
Odaka

(10) Patent No.: US 9,031,427 B2
(45) Date of Patent: May 12, 2015

(54) IMAGE FORMING APPARATUS AND METHOD OF CONTROLLING SAME

(71) Applicant: KYOCERA Document Solutions Inc., Osaka-shi, Osaka (JP)

(72) Inventor: Yoshiyuki Odaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/151,624

(22) Filed: Jan. 9, 2014

(65) Prior Publication Data

US 2014/0199086 A1 Jul. 17, 2014

(30) Foreign Application Priority Data

Jan. 11, 2013 (JP) ..... 2013-003493

(51) Int. Cl.
*G03G 15/20* (2006.01)
*G03G 15/00* (2006.01)

(52) U.S. Cl.
CPC ..... *G03G 15/2053* (2013.01); *G03G 15/205* (2013.01)

(58) Field of Classification Search
USPC ..... 399/33, 37
See application file for complete search history.

(56) References Cited

U.S. PATENT DOCUMENTS 5,794,096 A * 8/1998 Okabayashi ..... 399/33
6,697,580 B2 * 2/2004 Nakayama ..... 399/33
8,301,051 B2 * 10/2012 Ogiso et al. ..... 399/69
2003/0053811 A1 * 3/2003 Takayama ..... 399/33
2004/0240898 A1 * 12/2004 Nonaka et al. ..... 399/33
2005/0047810 A1 3/2005 Nagatsuma et al.
2006/0018676 A1 * 1/2006 Ishii ..... 399/33
2012/0183312 A1 * 7/2012 Choi ..... 399/33

FOREIGN PATENT DOCUMENTS

JP 2005-99711 A 4/2005

OTHER PUBLICATIONS

English language abstract of JP 2005-99711, published Apr. 14, 2005.

* cited by examiner

*Primary Examiner* — David Bolduc
(74) *Attorney, Agent, or Firm* — NDQ&M Watchstone LLP

(57) ABSTRACT

An image forming apparatus includes: an image formation portion; a fixing portion that includes an exciting coil for inductively heating member and a temperature detection member: a main control portion that stops a printing operation when a temperature abnormality is recognized; a notification portion; a power supply portion that supplies power to the exciting coil; and a heating control portion that controls power supply to the exciting coil and detects the power abnormality. When the heating control portion detects a power abnormality, the heating control portion stops the induction heating, provides stop notice; when the main control portion determines, based on the history of the stop notice, whether the temperature abnormality is due to the stop of the induction heating or is not due to the stop of the induction heating.

14 Claims, 6 Drawing Sheets

IMAGE FORMING APPARATUS AND METHOD OF CONTROLLING SAME

This application is based upon and claims the benefit of priority from the corresponding Japanese Patent Application No. 2013-003493 filed on Jan. 11, 2013, the entire contents of which are incorporated herein by reference.

BACKGROUND

The present disclosure relates to an image forming apparatus that uses induction heating to fix toner to a sheet.

Some of the image forming apparatuses such as a multifunctional peripheral, a copying machine, a printer and a facsimile machine use toner to perform image formation. In such an image forming apparatus, a toner image is transferred to a sheet while the sheet is being transported therewithin, and heating and pressurizing are performed to fix the toner image to the sheet. In some of the image forming apparatuses that fix the toner to perform printing, an induction heating method is used to perform the fixing.

A fixing control device that uses the following induction heating method to perform fixing is known. Specifically, the fixing control device includes: a main body control circuit that has a main central processing unit controlling the operation of the entire device; a temperature sensor that detects the temperature of a fixing heated member; an exciting coil for inductively heating the fixing heated member by receiving current supply; and an induction heating control circuit that has a sub-central processing unit independent of the main central processing unit to control the current supply to the exciting coil, where based on information on the temperature detected by the temperature sensor, the main central processing unit uses only a power instruction signal to provide a control instruction to the sub-central processing unit.

In the image forming apparatus of the induction heating method, as in the fixing control device described above, a plurality of control portions may be provided, and the roles of the induction heating are allocated. Specifically, a main control portion that controls the image forming apparatus is made to provide an instruction of power to be supplied to the exciting coil based on the temperature of a heating rotation member. The control portion provided in a fixing portion may be made to perform actual control for supplying power on the exciting coil based on an instruction from the main control portion.

On the other hand, in order for a fixing failure and overheating in the fixing portion to be prevented, the detection of a temperature abnormality in the heating rotation member based on the output from the temperature sensor is performed. The detection of an abnormality in a voltage or a current, that is, power supplied to the exciting coil may be performed. When a temperature abnormality or a power abnormality is detected, the stop of a printing operation and/or the stop of power supply to the exciting coil is performed. Thus, printing and power supply in an inappropriate state are prevented.

Conventionally, when such an abnormality occurs in the fixing portion, in the image forming apparatus, notification of the abnormality is provided. For example, on the display portion of the image forming apparatus, information that an abnormality is produced in the fixing portion or information that checking or repair is needed is displayed.

Here, the temperature abnormality in which the temperature of the heating rotation member of the fixing portion is lower than a temperature to be detected may be caused by the stop of the power supply to the exciting coil resulting from an abnormality in supply power or may be caused by an abnormality in the temperature sensor. However, conventionally, when the temperature abnormality is produced, notification is not provided for each cause. Hence, although there is a problem in a power supply system that supplies power to the exciting coil, a service person may erroneously determine that the cause is present in the temperature sensor. On the contrary, although the cause is preset in the temperature sensor, a service person may erroneously determine that there is a problem in the power supply system that supplies power to the exciting coil. As described above, when a temperature abnormality is produced in the fixing portion, it is disadvantageously difficult to determine the cause of the abnormality.

A fixing device controlled by the known fixing control device described above performs induction heating. However, it is impossible to solve the problem in which it is difficult to determine the cause of the temperature abnormality produced in the fixing portion.

SUMMARY

According to a first aspect of the present disclosure, there is provided an image forming apparatus including an image formation portion, a fixing portion, a main control portion, a notification portion, a power supply portion and a heating control portion. The image formation portion forms a toner image to transfer the formed toner image to a sheet. The fixing portion includes a heating rotation member, a pressurizing rotation member which is pressed onto the heating rotation member to form a fixing nip, an exciting coil for inductively heating the heating rotation member and a temperature detection member for detecting a temperature of the heating rotation member and passes, through the fixing nip, the sheet to which the toner image has been transferred so as to fix the toner image to the sheet. The main control portion recognizes the temperature of the heating rotation member based on an output of the temperature detection member, and recognizes a temperature abnormality, and stops a printing operation performed by the image formation portion and the fixing portion when the temperature of the heating rotation member is maintained at a fixing control temperature which is a temperature suitable for the fixing and the temperature of the heating rotation member falls within a predetermined temperature abnormality range. The notification portion provides abnormality notification when the main control portion recognizes the temperature abnormality. The power supply portion supplies power to the exciting coil. The heating control portion controls power supply from the power supply portion to the exciting coil and detects supply power to the exciting coil, detects, when the detected supply power falls outside a predetermined supply condition, a power abnormality which is an abnormality in the supply power to the exciting coil. When the power abnormality is detected in a state that control for supplying power on the exciting coil is performed, the heating control portion stops the power supply to stop the induction heating and provides, to the main control portion, stop notice indicating that the induction heating is stopped by the power abnormality; the main control portion determines, based on a history of the stop notice from the heating control portion, whether or not the temperature abnormality is based on the stop of the induction heating, and the main control portion makes the notification portion notify a power supply abnormality when it is determined that the temperature abnormality is due to the stop of the induction heating whereas the main control portion makes the notification portion notify an abnormality in the fixing portion when it is determined that the temperature abnormality is not due to the stop of the induction heating.

Further features and advantages of the present disclosure will become apparent from the description of embodiments given below.

DETAILED DESCRIPTION

An image forming apparatus including a fixing portion 1 will be described below with reference to FIGS. 1 to 6. An embodiment of the present disclosure will be described using an example of a printer 100 as the image forming apparatus. Elements such as configurations and arrangements described in the embodiment do not limit the scope of the disclosure, and are simply illustrative.

(Schematic Configuration of the Image Forming Apparatus)

Figure 1:
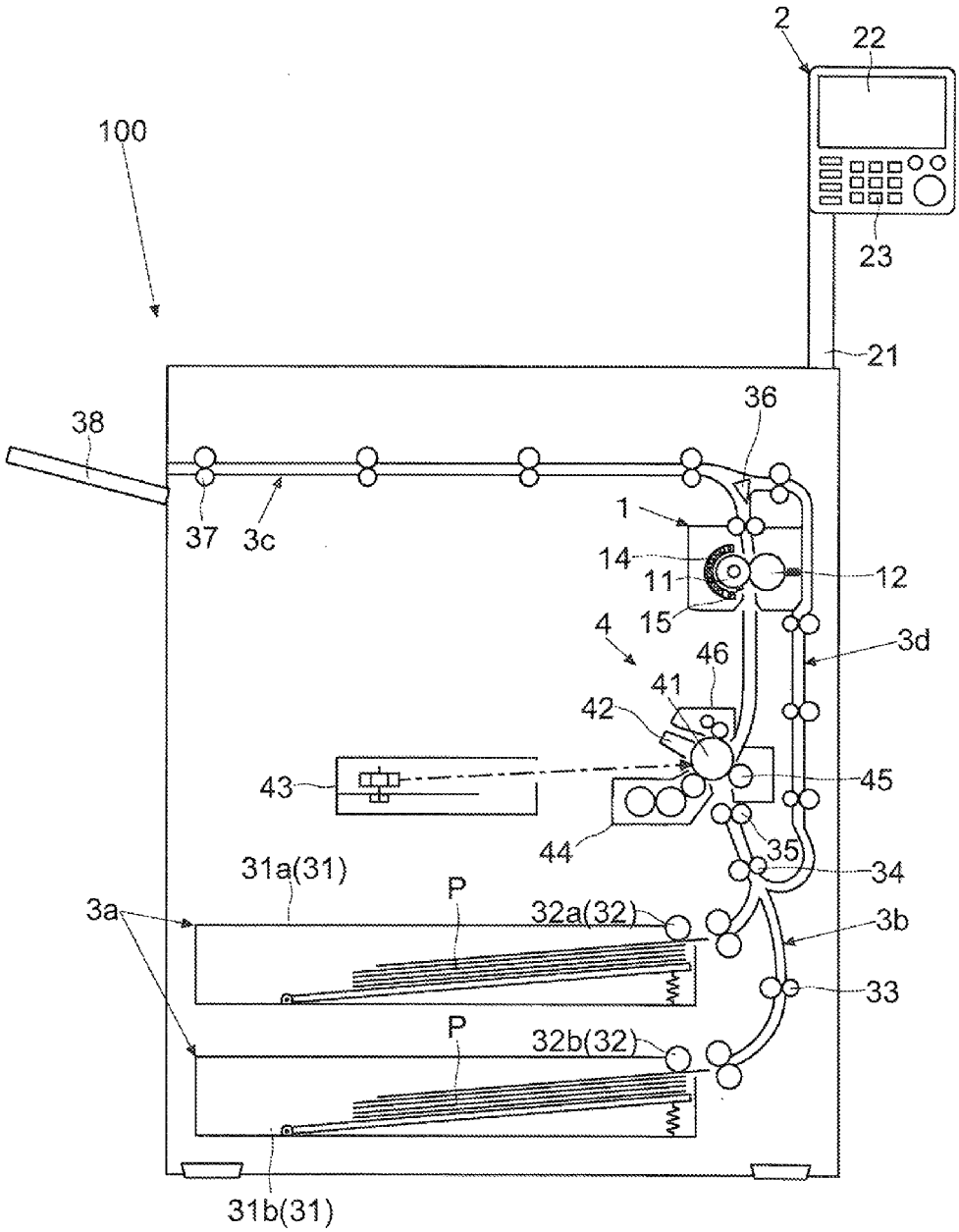
FIG. 1 is a diagram showing the configuration of a printer.

The printer 100 will be schematically described with reference to FIG. 1. FIG. 1 is a diagram showing the configuration of the printer 100.

As shown in FIG. 1, the printer 100 of the present embodiment includes an operation panel 2 attached to its side. The printer 100 includes a paper feed portion 3*a*, a first transport portion 3*b*, an image formation portion 4, a fixing portion 1 and a second transport portion 3*c*.

As shown in FIG. 1, in the printer 100, the operation panel 2 corresponding to a notification portion is provided. The operation panel 2 is provided at the end of an arm 21 placed on the right side of the upper portion of the printer 100. The operation panel 2 includes a display position 22 that displays the state of the printer 100, various types of messages or a setting screen. The display position 22 is a liquid crystal display panel or an organic EL display panel, and has a touch panel system. In the operation panel 2, a plurality of setting and input keys 23 are provided. The operation panel 2 receives settings such as printing conditions like the type and size of a sheet P used for printing performed by a user. The operation panel 2 displays the state of the printer 100 or an error occurring in the printer 100 to provide notification to a user.

As shown in FIG. 1, in a lower portion of the interior of the printer 100, the paper feed portion 3*a* is arranged. The paper feed portion 3*a* includes a plurality of cassettes 31. In FIG. 1, the upper cassette is represented by symbol 31*a*, and the lower cassette is represented by symbol 31*b*. The cassettes 31 hold a plurality of sheets P such as copying sheets P, OHP sheets and label sheets. For each of the cassettes 31, a paper feed roller 32 is provided that is rotated by a drive mechanism (not shown) such as a motor and a gear. In FIG. 1, the upper roller is represented by symbol 32*a*, and the lower roller is represented by symbol 32*b*. The paper feed roller 32 is rotated to feed the sheet P out to the first transport portion 3*b*.

The first transport portion 3*b* transports the sheet P within the printer 100. The first transport portion 3*b* transports the sheet P substantially vertically along the right side surface of the main body of the printer 100. The first transport portion 3*b* guides the sheet P supplied from the paper feed portion 3*a* to the image formation portion 4. In the first transport portion 3*b*, a registration roller pair 35 is provided. The registration roller pair 35 places the sheet P transported from transport roller pairs 33 and 34 on standby in front of the image formation portion 4, and feeds the sheet P out to the image formation portion 4 in synchronization with the timing at which the toner image is transferred.

The image formation portion 4 forms, based on image data on an image to be formed, the toner image, and transfers it to the sheet P. Specifically, the image formation portion 4 includes a photoconductive drum 41 and a charging portion 42, an exposure portion 43, a development portion 44, a transfer roller 45 and a cleaning portion 46, which are arranged around the photoconductive drum 41.

The photoconductive drum 41 can carry the toner image therearound, and is driven to rotate at a predetermined process speed. The charging portion 42 charges the photoconductive drum 41 with a given potential. The exposure portion 43 outputs, based on an image signal (image data) which is input, a laser beam indicated by alternate long and short dashed lines to scan and expose the charged photoconductive drum 41. Thus, an electrostatic latent image is formed on the surface of the photoconductive drum 41. The exposure portion 43 receives image data after being subjected to image processing through an image processing portion 53 (see FIG. 2) of a main control portion 5, and applies the laser light to the photoconductive drum 41 based on the image data to perform the scanning and the exposure.

The development portion 44 supplies the toner to the photoconductive drum 41 to develop the electrostatic latent image formed on the circumferential surface of the photoconductive drum 41. The cleaning portion 46 cleans the photoconductive drum 41. The transfer roller 45 is pressed onto the photoconductive drum 41. Then, the registration roller pair 35 feeds the sheet P into the nip between the photoconductive drum 41 and the transfer roller 45 such that the formed toner image is transferred to a predetermined position of the sheet P. Then, a predetermined transfer voltage is applied to the transfer roller 45. Thus, the toner image is transferred to the sheet P.

The fixing portion 1 is arranged on the downstream side of the transport direction of the sheet P with respect to the image formation portion 4. The fixing portion 1 includes a heating roller 11 that corresponds to a heating rotation member and a pressurizing roller 12 that corresponds to a pressurizing rotation member. The heating roller 11 is subjected to induction heating. The pressurizing roller 12 is pressed onto the heating roller 11. The fixing portion 1 also includes a temperature sensor 15 that corresponds to a temperature detection member. The sheet P to which the toner image has been transferred is heated and pressurized when the sheet P is passed through the fixing nip F between the heating roller 11 and the pressurizing roller 12. Consequently, the toner image is fixed to the sheet P. The sheet P which has been subjected to the fixing is moved toward the second transport portion 3*c* provided above the fixing portion 1.

The sheet P fed out of the fixing portion 1 is transported along the second transport portion 3*c* extending substantially horizontally from a branch portion 36 toward the left side surface of the printer 100. Then, the sheet P to which the toner image has been fixed is ejected by an ejection roller pair 37 to an ejection tray 38 provided on the outside of an upper portion of the left side surface of the printer 100. When double-sided copying is performed, the sheet P fed out of the fixing portion 1 is temporarily fed out from the branch portion 36 in the direction of the ejection tray 38, and thereafter its transport direction is switched back to the direction of the right side surface of the printer 100. Then, the sheet P is passed through the branch portion 36, is fed downward through a double-sided transport portion 3*d* and is fed again to the upstream side of the registration roller pair 35 through the first transport portion 3*b*.

(Hardware Configuration of the Printer 100)

Figure 2:
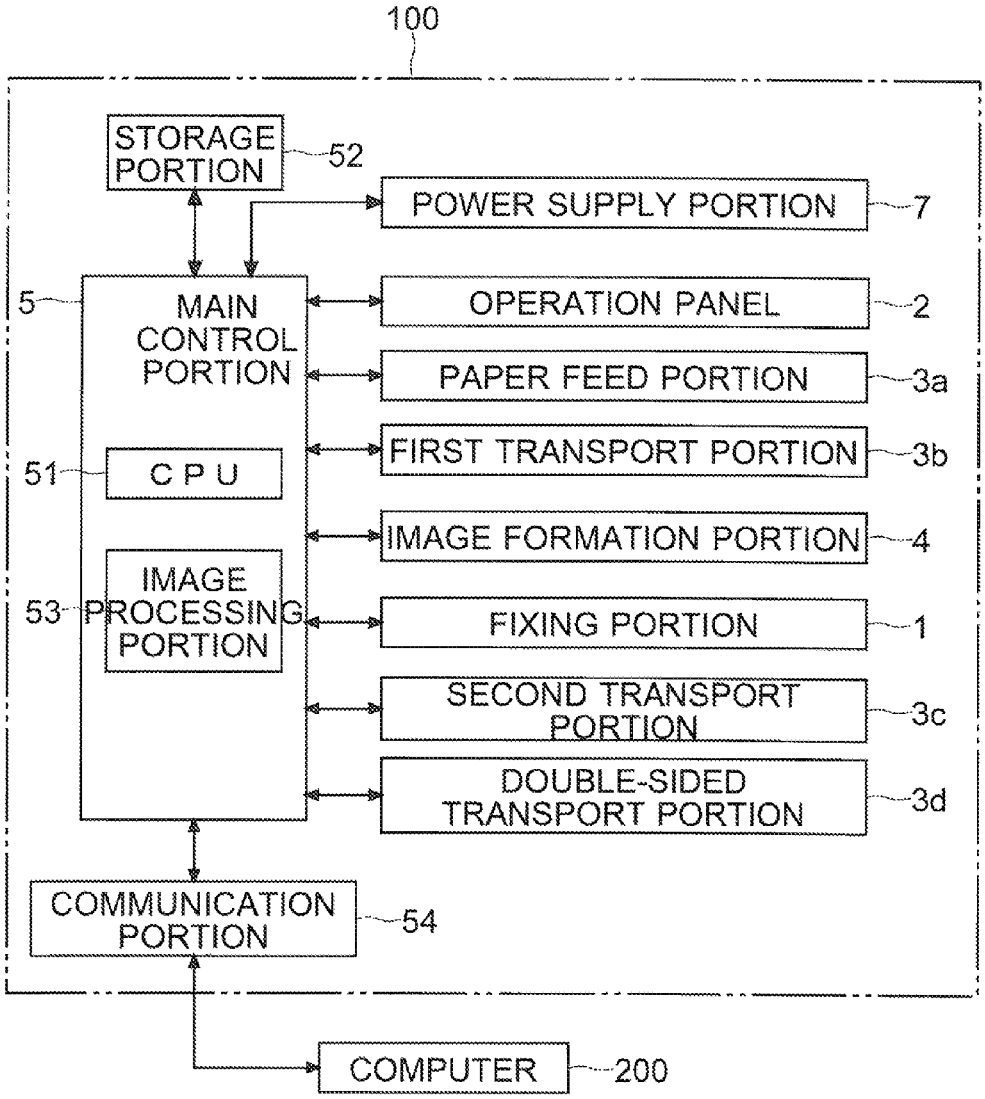
FIG. 2 is a diagram showing the hardware configuration of the printer.

With reference to FIG. 2, the hardware configuration of the printer 100 according to the present embodiment will now be described. FIG. 2 is a diagram showing the hardware configuration of the printer 100.

As shown in FIG. 2, the printer 100 according to the present embodiment includes a main control portion 5 therewithin. The main control portion 5 controls the individual portions of the apparatus. For example, the main control portion 5 includes a CPU 51, the image processing portion 53 and other electronic circuits and elements.

The main control portion 5 is connected to a storage portion 52. The CPU 51 is a central processing unit, and performs control and computation on the individual portions of the printer 100 based on a control program stored in the storage portion 52 to be developed. The storage portion 52 is formed with a combination of a nonvolatile storage device such as a ROM, a flash ROM or a HDD and a volatile storage device such as a RAM. The storage portion 52 stores not only the control program of the printer 100 but also various types of data such as control data.

The main control portion 5 is connected to the paper feed portion 3*a*, the first transport portion 3*b*, the image formation portion 4, the fixing portion 1, the second transport portion 3*c* and the double-sided transport portion 3*d*, which perform the image formation and the printing, such that the main control portion 5 can communicate with them. The main control portion 5 provides instructions to the paper feed portion 3*a*, the first transport portion 3*b*, the image formation portion 4, the fixing portion 1 and the like such that the image formation is appropriately performed based on the control program and the data stored in the storage portion 52.

A communication portion 54 is connected to the main control portion 5. The communication portion 54 is an interface through which to communicate with a computer 200 such as a personal computer or a server. The communication portion 54 communicates with the computer 200 through a network or a cable. The communication portion 54 receives image data or printing data containing printing settings from the computer 200. The main control portion 5 makes the image processing portion 53 process the image data based on the printing data, and makes the image formation portion 4 and the like perform the printing based on the image data after being subjected to the image processing.

The main control portion 5 is connected to the operation panel 2 such that the main control portion 5 can communicate with the operation panel 2. The main control portion 5 controls the display of the operation panel 2. The main control portion 5 also recognizes the details of a setting made in the operation panel 2.

(Configuration of the Fixing Portion 1)

Figure 3:
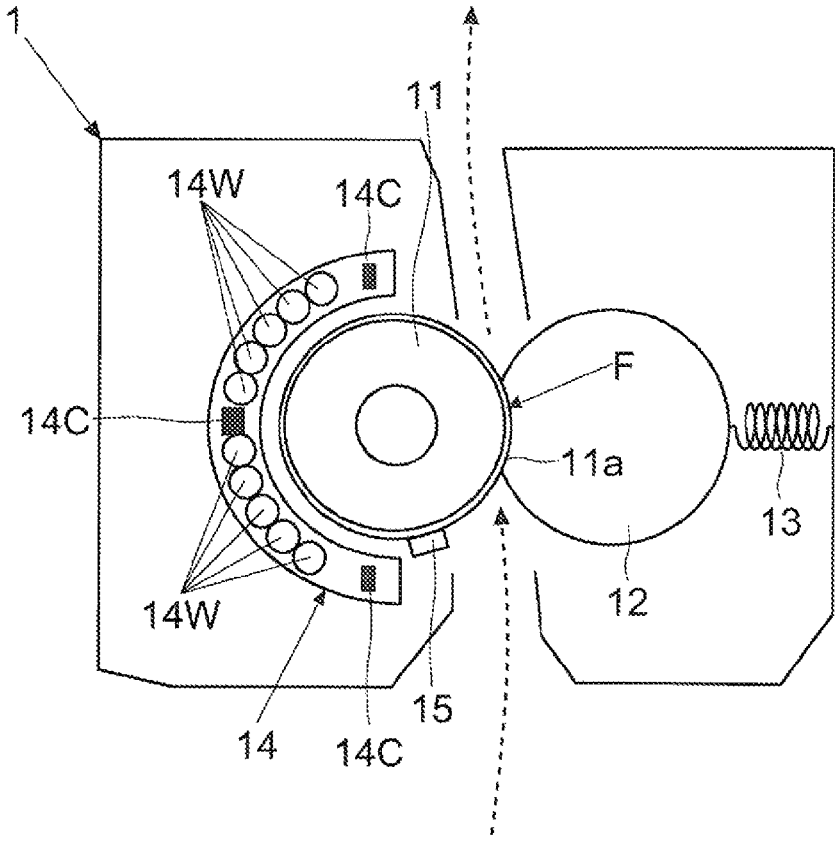
FIG. 3 is a front view of a fixing portion.

With reference to FIG. 3, the fixing portion 1 according to the present embodiment will now be described. FIG. 3 is a front view of the fixing portion 1.

As shown in FIG. 3, the fixing portion 1 of the present embodiment includes the heating roller 11, the pressurizing roller 12, a biasing member 13, an exciting coil 14 and the temperature sensor 15. The heating roller 11 and the pressurizing roller 12 are rotatably supported such that the directions of their axial lines are parallel to each other.

In the heating roller 11, the direction of its axial line is assumed to be the direction of the depth of the plane of FIG. 3 (the direction perpendicular to the sheet transport direction; the sheet width direction). The heating roller 11 is inductively heated by the exciting coil 14. The heating roller 11 is obtained by winding, around the surface of a metallic tubular pipe, a heating belt 11*a* formed of a metal such as nickel heated by an induction heating action through a magnetic flux from the exciting coil 14. The interior of the pipe of the heating roller 11 may be filled with a heat storage material. The heating roller 11 is not limited to the configuration described above as long as the heating roller 11 can be inductively heated.

The pressurizing roller 12 is provided opposite the heating roller 11. The circumferential surface of the pressurizing roller 12 has elasticity. The material of the circumferential surface of the pressurizing roller 12 is a material, such as silicon rubber, that has elasticity. The pressurizing roller 12 is pressed onto the heating roller 11. The biasing member 13 is a member, such as a spring, that applies a force in such a direction that the pressurizing roller 12 is pressed onto the heating roller 11. The fixing nip F for the fixing is formed by the pressing of the heating roller 11 onto the pressurizing roller 12.

The drive force of a fixing motor 16 (see FIG. 4) provided in the fixing portion 1 is transmitted to the pressurizing roller 12. Thus, the pressurizing roller 12 is rotated. When the pressurizing roller 12 is rotated, the heating roller 11 onto which the pressurizing roller 12 is pressed is driven to rotate accordingly. Then, the heating roller 11 and the pressurizing roller 12 are rotated, and thus the sheet P is passed through the fixing nip F. In this way, the toner image is heated and pressurized, and thus the toner image is fixed to the sheet P. In FIG. 3, the sheet transport direction is indicated by a broken line.

The exciting coil 14 will now be described. As shown in FIG. 3, on the side opposite to the side on which the pressurizing roller 12 is provided as seen from the heating roller 11, the exciting coil 14 is provided opposite the heating roller 11. As shown in FIG. 3, the exciting coil 14 is obtained by winding an electric wire 14W along the direction of the axial line of the heating roller 11 such that the exciting coil 14 is formed in the shape of the letter U when the heating roller 11 is seen in the circumferential direction.

The exciting coil 14 is obtained by winding the one electric wire 14W a plurality of times. The surface of the electric wire 14W is coated with an insulator. Both ends of the electric wire 14W serve as terminals, and voltage is applied to the terminals. Thus, a current flows through the exciting coil 14, and the magnetic flux is generated. The magnetic flux generated from the exciting coil 14 is linked to the heating belt 11*a* of the heating roller 11. In this way, the heating belt 11*a* is warmed by Joule heat resulting from eddy current. This induction heating allows the fixing portion 1 to be rapidly heated.

The position at which the heating is performed by the magnetic flux of the exciting coil 14 is displaced, and thus the heating roller 11 is rotated so that the heating roller 11 is uniformly warmed. The rotation of the heating roller 11 allows the heat to be also conducted to the pressurizing roller 12. Thus, the pressurizing roller 12 is also warmed. The heating roller 11 is inductively heated at the start of the printing or during the printing. On the other hand, between printing jobs or in a state where the image formation is not performed, such as in a low-power mode, the heating roller 11 is not inductively heated. When power is turned on or when warm-up processing at the time of return from the low-power mode is performed, the heating roller 11 may be inductively heated.

Within the exciting coil 14, three ferrite cores 14C are provided. As shown in FIG. 3, the ferrite cores 14C are provided, along the circumferential surface of the heating roller 11, at the center and at both ends of the wound wire of the exciting coil 14 when seen in the direction of the axial line. The ferrite cores 14C are designed to prevent the magnetic flux generated from the exciting coil 14 from being diffused and to effectively link the magnetic flux to the heating belt 11*a*.

In the fixing portion 1 of the present embodiment, the temperature sensor 15 is provided. The temperature sensor 15 is provided in the vicinity of a portion where the sheet P enters the fixing nip F such that the temperature sensor 15 is in contact with the heating roller 11. In other words, the temperature sensor 15 is a contact-type. The temperature sensor 15 includes a thermistor, and an output voltage is varied by the temperature of the heating roller 11 (the heating belt 11*a*). A plurality of temperature sensors 15 may be provided such that the temperatures of a plurality of positions in the direction of the axial line of the heating roller 11 are detected.

(Hardware Configuration of the Fixing Portion 1)

Figure 4:
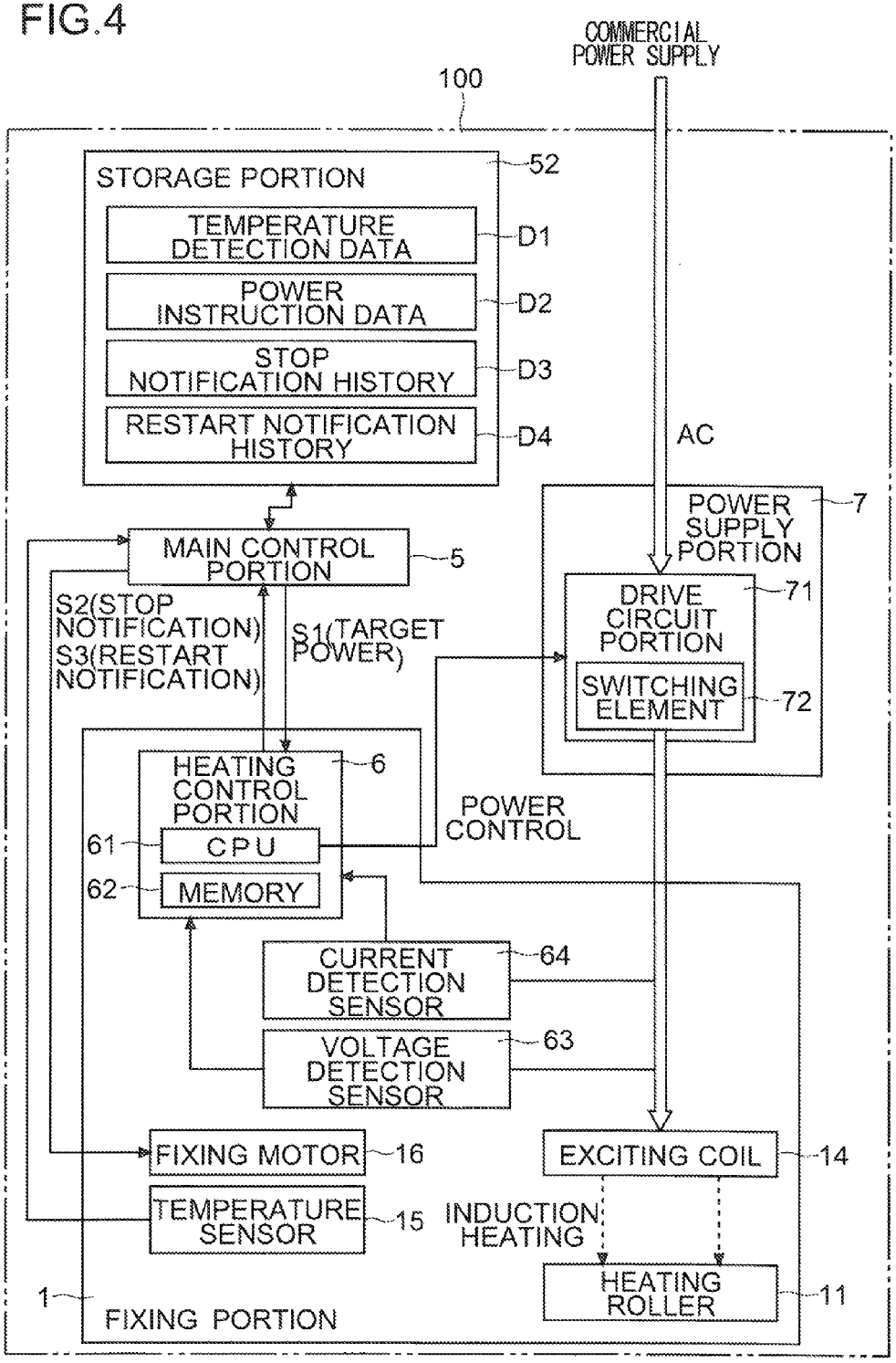
FIG. 4 is a diagram illustrating the hardware configuration of the fixing portion and portions related to the induction heating.

With reference to FIG. 4, the hardware configuration of the fixing portion 1 and portions related to the induction heating according to the present embodiment will now be described. FIG. 4 is a diagram illustrating the hardware configuration of the fixing portion 1 and the portions related to the induction heating.

As shown in FIG. 4, in the fixing portion 1 of the present embodiment, a heating control portion 6 that performs control on the heating of the fixing portion 1 is provided. The heating control portion 6 receives a target power instruction S1 from the main control portion 5 to perform heating control. The heating control portion 6 includes the CPU 61 and a memory 62 that stores data and programs on the control of the heating. The CPU 61 within the heating control portion 6 controls a drive circuit portion 71 to perform temperature control on the heating roller 11 by the induction heating (details of which will be described later).

In the fixing portion 1, a fixing motor 16 that drives to rotate the heating roller 11 and the pressurizing roller 12 is provided. For example, when the heating roller 11 is inductively heated, the main control portion 5 rotates the fixing motor 16.

As shown in FIG. 4, within the fixing portion 1, the exciting coil 14 is provided. A capacitor (not shown) is connected to the exciting coil 14, and thus a resonance circuit is formed. A power supply portion 7 that supplies power to the exciting coil 14 is provided. The heating control portion 6 controls the power supplied from the power supply portion 7 to the exciting coil 14.

With reference to FIG. 4, the power supply to the exciting coil 14 will now be described. A commercial power supply is connected to the power supply portion 7 of the printer 100 (the fixing portion 1). In other words, the commercial power supply inputs alternating-current power to the power supply portion 7. In the power supply portion 7, the drive circuit portion 71 that turns on and off the power supply to the exciting coil 14 is provided. The drive circuit portion 71 includes a switching element 72 for turning on and off the supply of the power to the exciting coil 14.

When the alternating-current power supplied from the commercial power supply is input to the exciting coil 14 without being converted, during one period of the waveform of the alternating-current voltage, the heating control portion 6 adjusts the timing (phase) at which the switching element 72 is turned on, and thereby controls the magnitude of the power supplied to the exciting coil 14.

The drive circuit portion 71 may be an inverter that converts the frequency of the alternating-current power supplied from the commercial power supply to output a given voltage. As the frequency is higher, it is more difficult for current to flow through the exciting coil 14; as the frequency is closer to the resonant frequency of the resonance circuit formed with the exciting coil 14 and the capacitor, a larger amount of current flows thought the exciting coil 14. Hence, when the inverter is used as the drive circuit portion 71, the heating control portion 6 provides, to the drive circuit portion 71, an instruction of the frequency of a voltage to be generated and input to the exciting coil 14, and controls the magnitude of the power supplied to the exciting coil 14.

The drive circuit portion 71 may be formed with a converter that rectifies and smoothes the commercial power to generate a given voltage and the switching element 72 that switches on and off the application of an output of the converter to the exciting coil 14. In this case, the heating control portion 6 controls the switching frequency of the switching element 72 to control the magnitude of the power supplied to the exciting coil 14.

As described above, the heating control portion 6 controls the drive circuit portion 71, and thereby can control the turning on and off of the power supply to the exciting coil 14 and the power input to the exciting coil 14.

As shown in FIG. 4, in the fixing portion 1 of the present embodiment, the temperature sensor 15 is provided. The output (voltage) of the temperature sensor 15 is input to the main control portion 5. Then, the main control portion 5 references temperature detection data D1 that is data on the temperature corresponding to the output voltage of the temperature sensor 15 stored in the storage portion 52. Thus, the main control portion 5 recognizes the temperature of the heating roller 11. The main control portion 5 recognizes the temperature of the heating roller 11 at predetermined intervals. The predetermined interval is about a hundred and several tens of milliseconds to several hundreds of milliseconds.

The main control portion 5 transmits, according to the recognized temperature, to the heating control portion 6, a target output to the exciting coil 14, that is, data (the target power instruction S1) indicating target power to be input to the exciting coil 14. The main control portion 5 transmits the data indicating the target power to the heating control portion 6 at intervals of about a hundred and several tens of milliseconds to several hundreds of milliseconds.

The lower temperature of the heating roller 11 is the higher target power indicated by the target power instruction S1 which is provides by control portion 5 to the heating control portion 6. As the temperature of the heating roller 11 is higher and is closer to a fixing control temperature, the main control portion 5 provides, to the heating control portion 6, the target power instruction S1 indicating lower target power. On the other hand, when the temperature of the heating roller 11 exceeds the fixing control temperature, the main control portion 5 provides, to the heating control portion 6, the target power instruction S1 to set the target power at zero.

Hence, the main control portion 5 provides, to the heating control portion 6, the target power instruction S1 indicating any value in a range from the maximum power, which can be input to the exciting coil 14, to 0 W. In the fixing portion 1 of the present embodiment, the fixing control temperature is about 170° C. The data indicating the target power for the temperature of the heating roller 11 is previously stored in the storage portion 52 as power instruction data D2. The main control portion 5 references the power instruction data D2 to determine the target power based on the recognized temperature.

(Basic Flow of Heating by the Heating Control Portion 6)

Figure 5:
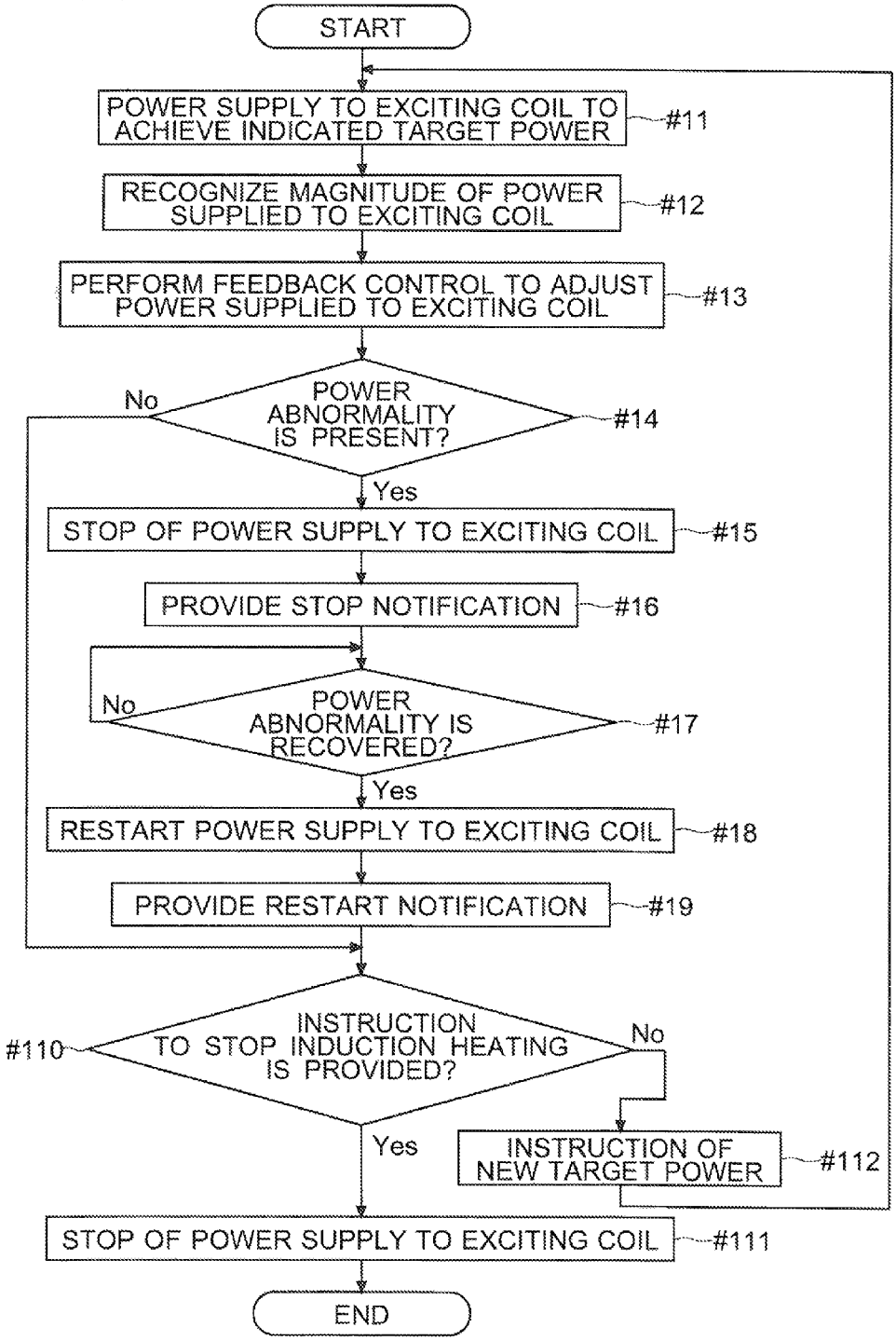
FIG. 5 is a flowchart showing the basic flow of heating by a heating control portion.

With reference to FIGS. 4 and 5, the basic flow of the induction heating of the heating roller 11 will now be described. FIG. 5 is a flowchart showing the basic flow of the heating by the heating control portion 6.

The start of FIG. 5 is the time when the heating control portion 6 receives, from the main control portion 5, an instruction indicating that the power supply to the exciting coil 14 is performed and receives the target power instruction 51 so that the temperature of the heating roller 11 is raised up to the fixing control temperature and then it is maintained at the fixing control temperature. As described above, when, for the printing, the heating roller 11 is heated to the fixing control temperature and the temperature thereof is maintained at the fixing control temperature, the main control portion 5 provides, to the heating control portion 6, an instruction to start the induction heating of the heating roller 11 and the target power instruction S1.

The heating control portion 6 controls the power supply portion 7 (the drive circuit portion 71) so as to supply the target power (consumption power) indicated from the main control portion 5, and supplies the power to the exciting coil 14 (step #11). When the heating control portion 6 receives an instruction indicating that the target power is set at zero, for example, because the temperature of the heating roller 11 exceeds the fixing control temperature, the power supply to the exciting coil 14 is temporarily stopped.

Then, as shown in FIG. 4, in the fixing portion 1, for the power supplied to the exciting coil 14, a voltage detection sensor 63 and a current detection sensor 64 are provided. The outputs of the voltage detection sensor 63 and the current detection sensor 64 are input to the heating control portion 6. Based on the outputs of the voltage detection sensor 63 and the current detection sensor 64, the heating control portion 6 recognizes the magnitude of the power supplied to the exciting coil 14 (step #12).

The memory 62 of the heating control portion 6 stores, according to the outputs of the voltage detection sensor 63 and the current detection sensor 64, data indicating an input voltage value, an input current value and input power to the exciting coil 14. The heating control portion 6 references the outputs of the voltage detection sensor 63 and the current detection sensor 64 and the data to recognize the magnitude of the input power to the exciting coil 14.

Then, the heating control portion 6 performs feedback control to make the drive circuit portion 71 adjust the power supplied to the exciting coil 14 such that the consumption power of the exciting coil 14 is equal to the target power (step #13). In other words, the heating control portion 6 controls the drive circuit portion 71 so as to compensate for a difference between the target power and the recognized consumption power of the exciting coil 14, and thereby adjusts the power supplied to the exciting coil 14. Thus, when the consumption power of the exciting coil 14 is displaced from the target power by an error or the like, the power supplied to the exciting coil 14 is adjusted.

When the consumption power of the exciting coil 14 is lower than the target power, the heating control portion 6 controls the drive circuit portion 71 to increase the power supplied to the exciting coil 14. On the other hand, when the consumption power of the exciting coil 14 is higher than the target power, the heating control portion 6 controls the drive circuit portion 71 to reduce the power supplied to the exciting coil 14. The memory 62 stores data indicating how the drive circuit portion 71 is controlled according to the magnitude of the difference between the target power and the recognized consumption power of the exciting coil 14. Based on the data stored in the memory 62, the heating control portion 6 controls the drive circuit portion 71 according to the magnitude of the difference between the target power and the recognized consumption power of the exciting coil 14. As described above, the heating control portion 6 controls the drive circuit portion 71 such that the recognized power supplied to the exciting coil 14 is equal to the target power.

Based on the outputs of the voltage detection sensor 63 and the current detection sensor 64, the heating control portion 6 detects whether or not an abnormality is produced in the power supplied to the exciting coil 14 (step 414). In other words, the heating control portion 6 detects whether or not the power or current supplies to the exciting coil 14 falls outside predetermined supply conditions. The abnormality of the power supplied to the exciting coil 14 can be caused by various factors such as an increase in the consumption power of a device connected to the same outlet as the printer 100, temporary noise and closely packed wirings.

When the voltage applied to the exciting coil 14 falls outside the predetermined supply conditions, the heating control portion 6 determines that a power abnormality is produced. The rating of the magnitude of the voltage applied by the drive circuit portion 71 to the exciting coil 14 is assumed to be determined by specifications. When, for the voltage value of the rating of the specifications, the recognized voltage value falls outside a voltage value range that is previously determined as the range of voltage values capable of guaranteeing the operation, the heating control portion 6 determines that a power abnormality is produced. In other words, when the heating control portion 6 detects the magnitude of the voltage applied from the power supply portion 7 to the exciting coil 14, and the voltage value falls outside a predetermined voltage value range, the heating control portion 6 detects that a power abnormality is produced. In the printer 100 of the present embodiment, when the voltage value falls outside a range of ±10 to 15% of the magnitude of the voltage of the rating of the specifications, the heating control portion 6 determines that a power abnormality is produced.

The predetermined supply conditions may be determined for the current. When, for the magnitude of an ideal current at the time of the supply of the target power to the exciting coil 14, a current falling outside the predetermined supply conditions flows, the heating control portion 6 determines that a power abnormality resulting from an abnormality in the current value is produced.

When a power abnormality is produced (yes in step #14), since it is not preferable to continue the power supply to the exciting coil 14, the heating control portion 6 voluntarily stops the power supply to the exciting coil 14 (step #15). In other words, the heating control portion 6 stops the induction heating caused by the exciting coil 14.

Furthermore, based on the power abnormality, the heating control portion 6 provides, to the main control portion 5, stop notice 52 indicating that the power supply to the exciting coil 14 is stopped (step #16). Thus, the main control portion 5 can recognize that the heating control portion 6 stops the power supply to the exciting coil 14 due to an abnormality in the voltage or the current. The main control portion 5 stores, in the storage portion 52, the information that the stop notice S2 is provided and the time when the stop notice S2 is received and, leaves them as a stop notice history D3.

Then, the heating control portion 6 determines whether or not the abnormality in the voltage applied to the exciting coil 14 is recovered, and thus the power abnormality is recovered (step #17). The heating control portion 6 continues the determination until the voltages falls within the predetermined supply conditions and the power abnormality is recovered (no in step #17→step #17).

On the other hand, when the power abnormality is recovered (yes in step #17), the heating control portion 6 restarts the power supply based on the target power instruction S1 to the exciting coil 14 (step #18). The heating control portion 6 provides, to the main control portion 5, restart notice S3 indicating that power abnormality is recovered and then the power supply to the exciting coil 14 is restarted (step #19). In other words, when the heating control portion 6 recognizes that the power abnormality is recovered, the heating control portion 6 restarts the power supply to the exciting coil 14 and also provides the restart notice S3 to the main control portion 5. Thus, the main control portion 5 can recognize that the voltage or current abnormality is recovered to the normal range, and that the heating control portion 6 restarts the power supply to the exciting coil 14. The main control portion 5 stores, in the storage portion 52, the information that the restart notice S3 is provided and the time when the restart notice S3 is received and, leaves them as a restart notice history D4.

At the time of no power abnormality (no in step #14) or after step #19, the heating control portion 6 determines whether or not an instruction of the stop of the induction heating is received (step #110). In the case of the completion of the printing or the like, the main control portion 5 provides the instruction of the stop of the induction heating to the heating control portion 6. In other words, when it is not necessary to warm the heating roller 11 at the fixing control temperature, the main control portion 5 provides, to the heating control portion 6, an instruction of the stop of the power supply to the exciting coil 14.

When the heating control portion 6 receives the instruction of the stop of the induction heating from the main control portion 5 (yes in step #110), the heating control portion 6 stops the power supply to the exciting coil 14 (step #111→end). Then, in the case of the start of the printing job, the present flow is started again. Although the present description has been given of the example where when the printing is completed, the induction heating is stopped, in the normal mode (before the transfer to the low-power mode), the main control portion 5 may make the heating control portion 6 intermittently supply the power to the exciting coil 14 such that the temperature of the heating roller 11 is maintained at the fixing control temperature.

On the other hand, when the heating control portion 6 does not receives the instruction of the stop of the induction heating from the main control portion 5 (no in step #110), the heating control portion 6 receives a new target power instruction S1 from the main control portion 5 (step #112). Then, the flow returns to step #11.

(Detection and Notification of the Temperature Abnormality)

Figure 6:
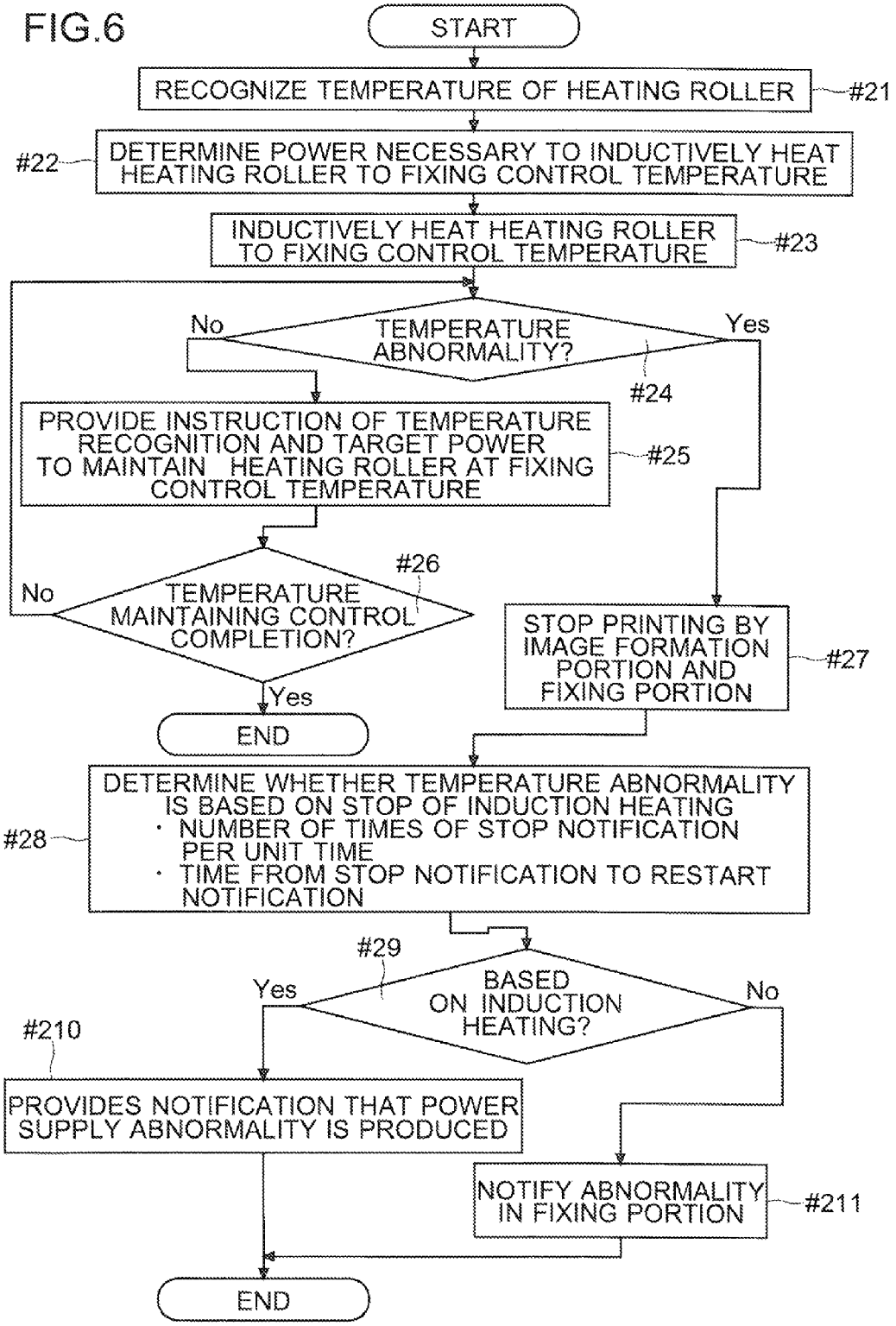
FIG. 6 is a flowchart showing the flow of the detection of a temperature abnormality and the notification of an abnormality.

With reference to FIG. 6, the detection of the temperature abnormality and the notification of the abnormality by the main control portion 5 in the printer 100 of the present embodiment will now be described. FIG. 6 is a flowchart showing the flow of the detection of the temperature abnormality and the notification of the abnormality.

The main control portion 5 recognizes the temperature of the heating roller 11 based on the output of the temperature sensor 15. Then, although the main control portion 5 provides the target power instruction S1 to the heating control portion 6, when the temperature of the heating roller 11 falls outside the predetermined temperature range and the temperature of the heating roller 11 is excessively high or low, the main control portion 5 detected that an abnormality in the temperature of the heating roller 11 occurs. Hence, with reference to FIG. 6, the flow of the detection of the temperature abnormality and the notification of the abnormality will be described.

The start of FIG. 6 is when the power supply to the exciting coil 14 is started so that, for example, at the start of the printing, the main control portion 5 makes the temperature of the heating roller 11 reach the fixing control temperature.

In the present flow, as described with reference to FIG. 5, the heating control portion 6 provides, to the main control portion 5, the stop notice 52 and the restart notice S3 according to the conditions of the power supply to the exciting coil 14, and the main control portion 5 receives the notification described above.

When the heating roller 11 is inductively heated to the fixing control temperature, the main control portion 5 first recognizes, based on the output of the temperature sensor 15, the temperature of the heating roller 11 (step #21). Then, the main control portion 5 determines, based on the recognized temperature, power necessary to inductively heat the heating roller 11 to the fixing control temperature (step #22). Then, the main control portion 5 provides, based on the determined power, an instruction of the target power to the heating control portion 6, and thus the heating roller 11 is inductively heated to the fixing control temperature (step #23). When the recognized temperature is lower than the fixing control temperature by a predetermined temperature or more, the main control portion 5 provides, to the heating control portion 6, the target power instruction S1 indicating the maximum power that can be input to the exciting coil 14. When the recognized temperature is higher than the predetermined temperature or more but is lower than the fixing control temperature, the control portion 5 provides, to the heating control portion 6, the target power instruction S1 indicating the maximum power that can be input to the exciting coil 14 or less but power that is higher as the temperature is lower.

When the heating roller 11 is inductively heated to the fixing control temperature from the state where the temperature of the heating roller 11 is cooled to around the room temperature, the power necessary to warm the heating roller 11 to the fixing control temperature is increased. On the other hand, when the heating roller 11 is warmed to some degree such as when the printer 100 is reset, the power necessary to warm the heating roller 11 to the fixing control temperature is decreased.

Then, the main control portion 5 determines whether or not a temperature abnormality is produced in the heating roller 11 that is inductively heated so as to maintain the fixing control temperature based on the output of the temperature sensor 15 (step #24). In the printer 100 of the present embodiment, when the temperature maintaining control is performed while the feedback control is performed with the fixing control temperature set at 170° C., the temperature of the heating roller 11 is maintained substantially within a range of about 160 to about 180° C.

Hence, when after the temperature of the heating roller 11 reaches the fixing control temperature, the temperature of the heating roller 11 is maintained at the fixing control temperature, if the temperature of the heating roller 11 reaches a range (abnormal temperature range) of about the room temperature to about 100° C., the main control portion 5 recognizes that a temperature abnormality is produced. In other words, when control is performed such that the temperature of the heating roller 11 is maintained at the fixing control temperature, if the temperature of the heating roller 11 falls within the abnormal temperature range, the main control portion 5 recognizes that a temperature abnormality is produced. The abnormal temperature range may be set on the side of a temperature higher than the fixing control temperature. Although the abnormal temperature range can be set at, for example, 250° C. or more, the setting is preferably determined appropriately in consideration of the members used in the printer 100.

When no temperature abnormality is produced (no in step #24), the main control portion 5 recognizes the temperature of the heating roller 11 and provides the target power instruction S1, and thereby maintains the temperature of the heating roller 11 at the fixing control temperature (step #25).

Then, the main control portion 5 determines whether or not the temperature maintaining control in which the temperature of the heating roller 11 is maintained at the fixing control temperature needs to be completed (step #26). In the printer 100 of the present embodiment, when the printing is completed, the main control portion 5 determines that the temperature maintaining control is completed. When the temperature maintaining control needs to be completed, the present flow is completed. On the other hand, when the temperature maintaining control needs to be continued such as when the printing is continued, the flow returns to step #24.

On the other hand, when a temperature abnormality is produced such as when the temperature of the heating roller 11 reaches 100° C. or lower even though the temperature maintaining control is performed (yes in step #24), the main control portion 5 stops the printing using the image formation portion 4, the fixing portion 1, the second transport portion 3*c*, the first transport portion 3*b* and the paper feed portion 3*a* (step #27).

Furthermore, the main control portion 5 determines, based on the history of communication with the heating control portion 6, whether or not the temperature abnormality is based on the stop of the induction heating (step #28). In other words, the main control portion 5 references the stop notice history D3 that is the communication history of the stop notice S2 received from the heating control portion 6 and the restart notice history D4 that is the communication history of the restart notice S3, and thereby determines whether or not the temperature abnormality is based on an abnormality in the power supplied to the exciting coil 14. As described above, in the printer 100 of the present embodiment, even when the power supply to the exciting coil 14 is temporarily stopped, and the stop notice S2 is received from the heating control portion 6, the main control portion 5 makes the image formation portion 4 and the fixing portion 1 continue to perform the printing operation until a temperature abnormality is recognized.

When the power supply to the exciting coil 14 is stopped by the determination of the heating control portion 6 due to an abnormality in the power input to the printer 100 or an abnormality in the circuit of the power supply portion 7, the temperature of the heating roller 11 is gradually lowered. Hence, the main control portion 5 determines whether or not the temperature of the heating roller 11 is lowered by an abnormality in the power supply system.

Specifically, the main control portion 5 determines that the temperature abnormality is due to the stop of the induction heating, based on the fact that the number of times the stop notice S2 is provided per unit time from the start of the induction heating exceeds a predetermined number of times or on the fact that, in a time from the start of the induction heating, a time elapsed since the reception of the stop notice S2 from the heating control portion 6 until the reception of the restart notice S3 exceeds a predetermined time. It is possible to appropriately determine the number of times the stop notice S2 is provided per unit time and the predetermined time in consideration of the degree to which the temperature of the heating roller 11 is lowered when the induction heating is stopped.

On the other hand, when the main control portion 5 recognizes the temperature abnormality after a predetermined extension time has elapsed without reception of the stop notice S2 from the restart notice S3, the main control portion 5 determines that the temperature abnormality is not due to the stop of the induction heating. This is because, since a time from the restart of the power supply to the exciting coil 14 elapses, it is admitted that a temperature abnormality is not caused by in the circuit supplying the power to the exciting coil 14 or an abnormality in the system. It is also possible to appropriately determine the predetermined extension time in consideration of the degree to which the temperature of the heating roller 11 is lowered when the induction heating is stopped. The main control portion 5 may determine that the temperature abnormality is not due to the stop of the induction heating, based on the fact that the number of times the stop notice S2 is provided per unit time from the start of the induction heating does not exceed a predetermined number of times or on the fact that, in a time from the start of the induction heating, a time elapsed since the reception of the stop notice S2 from the heating control portion 6 until the reception of the restart notice S3 does not exceed a predetermined time.

When the main control portion 5 determines that the temperature abnormality is due to the stop of the induction heating (yes in step #29), notification indicating that a power abnormality is produced in the operation panel 2 is provided (step #210).

On the other hand, when the main control portion 5 determines that the temperature abnormality is not due to the stop of the induction heating (no in step #29), it is thought that there is no abnormality in the power supply to the exciting coil 14 and that an abnormality is produced in the temperature sensor 15 of the fixing portion 1 or the like. Hence, when it is determined that the temperature abnormality is not due to the stop of the induction heating, the main control portion 5 makes the operation panel 2 notify the abnormality in the fixing portion 1 (step #211).

Thus, the image forming apparatus (the printer 100) of the present embodiment includes: the image formation portion 4 that forms a toner image to transfer the toner image to the sheet P; the fixing portion 1 that includes a heating rotation member (the heating roller 11), a pressurizing rotation member (the pressurizing roller 12) which is pressed onto the heating rotation member to form the fixing nip F, the exciting coil 14 for inductively heating the heating rotation member and a temperature detection member (the temperature sensor 15) for detecting the temperature of the heating rotation member and that passes, through the fixing nip F, the sheet P to which the toner image has been transferred so as to fix the toner image to the sheet P; the main control portion 5 that recognizes the temperature of the heating rotation member based on an output of the temperature detection member, and that recognizes a temperature abnormality, and stops a printing operation performed by the image formation portion 4 and the fixing portion 1 when the temperature of the heating rotation member is maintained at a fixing control temperature which is a temperature suitable for the fixing and the temperature of the heating rotation member falls within a predetermined temperature abnormality range; a notification portion (the operation panel 2) that provides abnormality notification when the main control portion 5 recognizes the temperature abnormality; a power supply portion 7 that supplies power to the exciting coil 14; and the heating control portion 6 that controls power supply from the power supply portion 7 to the exciting coil 14 and detects supply power to the exciting coil 14 and that detects, when the detected supply power falls outside a predetermined supply condition, a power abnormality which is an abnormality in the supply power to the exciting coil 14. The heating control portion 6 stops, when the power abnormality is detected in a state that control for supplying power on the exciting coil 14 is performed, the power supply to stop the induction heating and provides, to the main control portion 5, the stop notice S2 indicating that the induction heating is stopped due to the power abnormality, and the main control portion 5 determines, based on a history of the stop notice S2 from the heating control portion 6, whether or not the temperature abnormality is based on the stop of the induction heating, and the main control portion 5 makes the notification portion (the operation panel 2) notify a power supply abnormality when it is determined that the temperature abnormality is due to the stop of the induction heating whereas the main control portion 5 makes the notification portion notify an abnormality in the fixing portion 1 when it is determined that the temperature abnormality is not due to the stop of the induction heating.

In this way, the causes of the temperature abnormality are distinguished, and then notification is provided. Hence, a user or a service person can easily determine the cause of the abnormality. Thus, it is possible to remove a wasteful operation such as an operation of replacing the fixing portion 1 even though an abnormality is produced in the power supply system or an operation of checking the power supply system even though an abnormality is produced in the member of the fixing portion 1 such as the temperature detection member (the temperature sensor 15) or the exciting coil 14.

When the heating control portion 6 recognizes that the power abnormality is recovered, the heating control portion 6 restarts the power supply to the exciting coil 14, and provides, to the main control portion 5, the restart notice S3 indicating that the power supply to the exciting coil 14 is restarted. Thus, the main control portion 5 can recognize that the abnormality in the voltage and/or the current supplied to the exciting coil 14 is removed. Hence, even when the temperature abnormality is recognized after the removal of the abnormality in the voltage and/or the current, it is possible to determine that the temperature abnormality is not based on the abnormality in the voltage or the current supplied to the exciting coil 14.

When the number of times the stop notice S2 is provided per unit time exceeds a predetermined number of times and/or when a time elapsed since reception of the stop notice S2 from the heating control portion 6 until reception of the restart notice S3 exceeds a predetermined time, the main control portion 5 determines that the temperature abnormality is due to the stop of the induction heating. Thus, when it is highly likely that an abnormality is produced in the power supply system supplying the power to the exciting coil 14, the abnormality in the power supply is notified. It is therefore possible to accurately notify the cause of the temperature abnormality.

When the main control portion 5 recognizes the temperature abnormality after a predetermined extension time has elapsed without reception of the stop notice S2 from the restart notice S3, the main control portion 5 makes the notification portion (the operation panel 2) notify the abnormality in the fixing portion 1. In this way, when a temporary abnormality in the voltage and/or the current is recovered, and normal power is supplied to the exciting coil 14, it is not determined that an abnormality is produced in the power supply system. It is therefore possible to accurately determine the cause of the temperature abnormality.

Even when the main control portion 5 receives the stop notice S2 from the heating control portion 6, the main control portion 5 makes the image formation portion 4 and the fixing portion 1 continue to perform the printing operation until the temperature abnormality is recognized. In this way, even when an abnormality is produced in the voltage and/or the current applied to the exciting coil 14, the printing is prevented from being stopped immediately. Hence, even when a temporary voltage drop or noise causes an abnormality in the voltage and/or the current, the printing is continued. Consequently, each time a temporary abnormality in the voltage and/or the current is produced, the user does not need to perform the printing again.

The main control portion 5 determines, based on the recognized temperature, power necessary to maintain the fixing control temperature, and provides, to heating control portion 6, an instruction of power to be supplied to the exciting coil 14 based on the determined power, and the heating control portion 6 controls, based on the instruction from the main control portion 5, the power supplied from the power supply portion 7 to the exciting coil 14. In this way, the processing that the heating control portion 6 needs to perform is reduced, and thus it is possible to precisely and rapidly control the power supplied from the power supply portion 7 to the exciting coil 14.

The heating control portion 6 detects the magnitude of a voltage applied by the power supply portion 7 to the exciting coil 14, and detects that the power abnormality is produced when the detected magnitude of the voltage falls outside a predetermined voltage value range. In this way, when a voltage value which it is impossible to guarantee in terms of performance on the fixing is detected, it is possible to determine it as a power abnormality and stop the heating performed by the exciting coil 14.

The present disclosure can be regarded as a method invention.

Although the embodiment of the present disclosure has been described, the scope of the present disclosure is not limited to what has been described; various modifications are possible without departing from the spirit of the disclosure.

What is claimed is:

1. An image forming apparatus comprising:

an image formation portion that forms a toner image to transfer the formed toner image to a sheet;

a fixing portion that includes a heating rotation member, a pressurizing rotation member which is pressed onto the heating rotation member to form a fixing nip, an exciting coil for inductively heating the heating rotation member and a temperature detection member for detecting a temperature of the heating rotation member and that passes, through the fixing nip, the sheet to which the toner image has been transferred so as to fix the toner image to the sheet;

a main control portion that recognizes the temperature of the heating rotation member based on an output of the temperature detection member, and that recognizes a temperature abnormality, and stops a printing operation performed by the image formation portion and the fixing portion when the temperature of the heating rotation member is maintained at a fixing control temperature which is a temperature suitable for the fixing and the temperature of the heating rotation member falls within a predetermined temperature abnormality range;

a notification portion that provides abnormality notification when the main control portion recognizes the temperature abnormality;

a power supply portion that supplies power to the exciting coil; and a heating control portion that controls power supply from the power supply portion to the exciting coil and detects supply power to the exciting coil, that detects, when the detected supply power falls outside a predetermined supply condition, a power abnormality which is an abnormality in the supply power to the exciting coil, that stops, when the power abnormality is detected in a state that control for supplying power on the exciting coil is performed, the power supply to stop the induction heating and that provides, to the main control portion, stop notice indicating that the induction heating is stopped by the power abnormality, wherein the main control portion determines, based on a history of the stop notice from the heating control portion, whether or not the temperature abnormality is based on the stop of the induction heating, and the main control portion makes the notification portion notify a power supply abnormality when it is determined that the temperature abnormality is due to the stop of the induction heating whereas the main control portion makes the notification portion notify an abnormality in the fixing portion when it is determined that the temperature abnormality is not due to the stop of the induction heating.

2. The image forming apparatus according to claim 1, wherein, when the heating control portion recognizes that the power abnormality is recovered, the heating control portion restarts the power supply to the exciting coil, and provides, to the main control portion, restart notice indicating that the power supply to the exciting coil is restarted.

3. The image forming apparatus according to claim 2, wherein, when a number of times the stop notice is provided per unit time exceeds a predetermined number of times or when a case where a time elapsed since reception of the stop notice from the heating control portion until reception of the restart notice exceeds a predetermined time, the main control portion determines that the temperature abnormality is due to the stop of the induction heating.

4. The image forming apparatus according to claim 2, wherein, when the main control portion recognizes the temperature abnormality after a predetermined extension time has elapsed without reception of the stop notice from the restart notice, the main control portion makes the notification portion notify the abnormality in the fixing portion.

5. The image forming apparatus according to claim 1, wherein, even when the main control portion receives the stop notice from the heating control portion, the main control portion makes the image formation portion and the fixing portion continue to perform the printing operation until the temperature abnormality is recognized.

6. The image forming apparatus according to claim 1, wherein the main control portion determines, based on the recognized temperature, power necessary to maintain the fixing control temperature, and provides, to heating control portion, an instruction of power to be supplied to the exciting coil based on the determined power, and the heating control portion controls, based on the instruction from the main control portion, the power supplied from the power supply portion to the exciting coil.

7. The image forming apparatus according to claim 1, wherein the heating control portion detects a magnitude of a voltage applied by the power supply portion to the exciting coil, and detects that the power abnormality is produced when the detected magnitude of the voltage falls outside a predetermined voltage value range.

8. A method of controlling an image forming apparatus, comprising the following steps:

forming a toner image to transfer the formed toner image to a sheet;

using a fixing portion, which includes a heating rotation member, a pressurizing rotation member which is pressed onto the heating rotation member to form a fixing nip, an exciting coil for inductively heating the heating rotation member and a temperature detection member for detecting a temperature of the heating rotation member, so as to pass, through the fixing nip, the sheet to which the toner image has been transferred and to fix the toner image to the sheet;

recognizing the temperature of the heating rotation member based on an output of the temperature detection member, recognizing a temperature abnormality when the temperature of the heating rotation member is maintained at a fixing control temperature which is a temperature suitable for the fixing and the temperature of the heating rotation member falls within a predetermined temperature abnormality range and stopping a printing operation;

providing abnormality notification when the temperature abnormality is recognized;

supplying power to the exciting coil;

detecting supply power to the exciting coil, and detecting, when the detected supply power falls outside a predetermined supply condition, a power abnormality which is an abnormality in the supply power to the exciting coil;

stopping, when the power abnormality is detected with control for supplying power performed on the exciting coil, the power supply to stop the induction heating;

providing the stop notice indicating that the induction heating is stopped by the power abnormality, and determining, based on a history of the stop notice, whether or not the temperature abnormality is due to the stop of the induction heating;

notifying a power supply abnormality when it is deter ruined that the temperature abnormality is due to the stop of the induction heating; and notifying an abnormality in the fixing portion when it is determined that the temperature abnormality is not due to the stop of the induction heating.

9. The method of controlling an image forming apparatus according to claim 8, wherein, when the power abnormality is recovered, the power supply to the exciting coil is restarted, and restart notice indicating that the power supply to the exciting coil is restarted is provided.

10. The method of controlling an image forming apparatus according to claim 9, wherein, when a number of times the stop notice is provided per unit time exceeds a predetermined number of times or when a case where a time elapsed until the restart notice from the stop notice exceeds a predetermined time, it is determined that the temperature abnormality is due to the stop of the induction heating.

11. The method of controlling an image forming apparatus according to claim 9, wherein, when the temperature abnormality is recognized after a predetermined extension time has elapsed without reception of the stop notice from the restart notice, the abnormality in the fixing portion is notified.

12. The method of controlling an image forming apparatus according to claim 8, wherein, even when the stop notice is provided, the printing operation is continued until the temperature abnormality is recognized.

13. The method of controlling an image forming apparatus according to claim 8, wherein, based on the recognized temperature, power necessary to maintain the fixing control temperature is determined, and, based on the determined power, the power is supplied to the exciting coil.

14. The method of controlling an image forming apparatus according to claim 8, wherein a magnitude of a voltage applied to the exciting coil is detected, and it is detected that the power abnormality is produced when the detected magnitude of the voltage falls outside a predetermined voltage value range.

* * * * *